US010677491B2

(12) United States Patent
Mustakallio et al.

(10) Patent No.: US 10,677,491 B2
(45) Date of Patent: Jun. 9, 2020

(54) AIR DISTRIBUTION DEVICE

(71) Applicant: Halton Oy, Kausala (FI)

(72) Inventors: Panu Mustakallio, Kouvola (FI); Jukka Tonteri, Lahti (FI); Pekka Vuorimaa, Kausala (FI); Vesa Juslin, Uusikyla (FI); Jouni Kuntonen, Kouvola (FI); Ismo Gronvall, Kouvola (FI)

(73) Assignee: HALTON OY, Kausala (FI)

( * ) Notice: Subject to any disclaimer, the term of this patent is extended or adjusted under 35 U.S.C. 154(b) by 182 days.

(21) Appl. No.: 14/601,680

(22) Filed: Jan. 21, 2015

(65) Prior Publication Data

US 2015/0204574 A1 Jul. 23, 2015

(30) Foreign Application Priority Data

Jan. 21, 2014 (EP) ..... 14151943

(51) Int. Cl.
*F24F 13/08* (2006.01)
*F24F 13/068* (2006.01)
*F24F 13/06* (2006.01)

(52) U.S. Cl.
CPC ..... *F24F 13/082* (2013.01); *F24F 13/068* (2013.01); *F24F 2013/0608* (2013.01)

(58) Field of Classification Search
CPC ..... F24F 13/082; F24F 13/068; F24F 13/062
(Continued)

(56) References Cited

U.S. PATENT DOCUMENTS 2,251,682 A * 8/1941 Leadbetter ..... F24F 7/10 454/108
3,279,094 A * 10/1966 Blanton, Jr. ..... B01J 8/44 34/233

(Continued)

FOREIGN PATENT DOCUMENTS

DE 4037287 7/1991
DE 4037287 A1 * 7/1991 ..... F24F 13/068

(Continued)

OTHER PUBLICATIONS

European Search Report for EP 14151943, Completed by the European Patent Office dated May 27, 2014, 2 Pages.

*Primary Examiner* — Steven B McAllister
*Assistant Examiner* — Allen R Schult
(74) *Attorney, Agent, or Firm* — Brooks Kushman P.C.

(57) ABSTRACT

An air distribution device. The air distribution device an air distribution chamber arranged to receive a flow of ventilation air from the air outlet. The air distribution chamber further having one or more perforated throttling plates or meshes perpendicular to the inner perforated wall and perpendicular to the flow of ventilation air from the air outlet into the air distribution chamber. The air distribution device also includes a pressure equalization chamber formed between an inner air permeable front plate of the air distribution chamber and an outer front plate. A perforation-free area of the outer perforated front plate is smaller than the perforation-free area of the inner perforated front plate in order to equalize ventilation air pressure in the equalization chamber and to provide a uniform flow of air through the outer front plate.

19 Claims, 3 Drawing Sheets

(58) Field of Classification Search
USPC ..... 454/331
See application file for complete search history.

(56) References Cited

U.S. PATENT DOCUMENTS

| | | | | | |
|---|---|---|---|---|---|
| 3,631,788 | A * | 1/1972 | Larkfeldt | F24F 13/068 | 454/297 |
| 3,726,204 | A * | 4/1973 | Lindestrom | F24F 7/10 | 454/187 |
| 3,824,909 | A * | 7/1974 | Horneff | E04B 9/02 | 454/187 |
| 5,360,373 | A * | 11/1994 | Makulla | F24F 13/068 | 454/284 |
| 2012/0322356 | A1* | 12/2012 | Fujishiro | F24F 9/00 | 454/269 |

FOREIGN PATENT DOCUMENTS

| | | | | |
|---|---|---|---|---|
| DE | 9303151 | | 6/1993 | |
| DE | 19500884 | | 8/1995 | |
| DE | 19500884 | A1 * | 8/1995 | F24F 13/068 |
| EP | 0606078 | | 7/1994 | |
| EP | 0961088 | | 12/1999 | |
| WO | 8903961 | | 5/1989 | |
| WO | WO 8903961 | A1 * | 5/1989 | F24F 1/01 |

* cited by examiner

AIR DISTRIBUTION DEVICE

CROSS-REFERENCE TO RELATED APPLICATIONS

This application claims priority to EP application Serial No. 14151943.9 filed Jan. 21, 2014, the disclosure of which is hereby incorporated in its entirety by reference herein.

TECHNICAL FIELD

The present invention relates to building heating, ventilation and air conditioning systems. More specifically, the invention relates to an air distribution device.

BACKGROUND

Air ventilation systems consist of exhaust air ducts that are used to extract air from rooms and supply air ducts that are used to supply air to rooms. Air circulation between the supply air ducts and the exhaust air ducts via rooms is achieved either naturally or mechanically. Nowadays air circulation in buildings is usually achieved with Air Handling Units (AHU) that contain fans, heating or cooling elements, air filter racks or chambers, sound attenuators, and dampers. Air handling units are usually located on rooftops and they are connected to the exhaust air ducts and supply air ducts. The supply air ducts cannot be simply connected to room space via large uncovered openings because such large openings would lead to non-uniform air flow and draught which is unpleasant and harmful for occupants in the room space. Air distribution devices are used to distribute air uniformly in the room space. Air distribution devices are connected to air outlet ducts and usually comprise an array of openings arranged between the air outlet duct and the room space.

In displacement ventilation systems supply air from air outlet ducts is supplied at floor level close to occupants and air is extracted to the exhaust air ducts via outlets located above occupied zone, for example, at ceiling height. Heated air rises upwards due to its lower density and is collected via the outlets to the exhaust air ducts. The benefit of displacement ventilation systems is superior indoor air quality because supply air does not mix with contaminated heated air as much as in solutions where supply air distribution is arranged centrally or above occupants. Heated air becomes contaminated due to contamination sources such as electronic systems, electrical systems and occupants.

The challenge in the air distribution is most often to distribute air as uniformly as possible to a room without generating too much noise. This is especially important in the design of displacement ventilation systems where low-velocity air distribution devices are placed near the occupants.

Problems in prior art air distribution devices include non-uniform air distribution and unacceptable noise levels.

Therefore, it would be beneficial to have a solution which avoids the disadvantages of the prior art and where an air distribution device provides a uniform air distribution of supply air with reduced noise levels.

SUMMARY

According to an aspect of the invention, the invention is an air distribution device, comprising: an air outlet for ventilation air; an air distribution chamber arranged to receive a flow of ventilation air from the air outlet, the air distribution chamber being bounded by at least an inner perforated wall allowing air to exit from the distribution chamber, an air impermeable wall opposite the air outlet and an air impermeable wall contiguous with the air outlet, wherein the air distribution chamber further comprises at least one perforated throttling plate or throttling mesh perpendicular to the inner perforated wall and perpendicular to the flow of ventilation air from the air outlet into the air distribution chamber; and a pressure equalization chamber bounded by the inner perforated wall, an outer perforated wall parallel to the inner perforated wall within a distance from the inner perforated wall, a section of the air impermeable wall opposite the air outlet and a section of the air impermeable wall contiguous with the air outlet, wherein a perforation-free area of the outer perforated wall is smaller than the perforation free area of the inner perforated wall in order to equalize ventilation air pressure in the equalization chamber and to provide a uniform flow of air through the outer perforated wall.

In one embodiment of the invention, by perpendicular to the flow of ventilation air from the air outlet into the air distribution chamber is meant perpendicular to a longitudinal axis of the air distribution device, the longitudinal axis being between the air outlet, that is, the air impermeable wall having an opening to connect to the air outlet, and the air impermeable wall opposite the air outlet.

In one embodiment of the invention, the air distribution chamber is also bounded by at least one air impermeable wall.

In one embodiment of the invention, the air impermeable wall contiguous with the air outlet is flat.

In one embodiment of the invention, the distance between the inner perforated wall and the outer perforated wall is between 10 millimeters and 30 millimeters.

In one embodiment of the invention, a first perforated throttling plate or throttling mesh is mounted at a distance of less than millimeters 50 from the air outlet.

In one embodiment of the invention, a second perforated throttling plate or throttling mesh is mounted at a distance of more than 300 millimeters from the air outlet.

In one embodiment of the invention, a hydraulic diameter of perforations in the outer perforated wall is less than 3 millimeters.

In one embodiment of the invention, the perforations in the inner perforated plate are circular.

In one embodiment of the invention, the perforations in the outer perforated plate are circular.

In one embodiment of the invention, the inner perforated wall and the outer perforated wall are flat.

In one embodiment of the invention, the inner perforated wall and the outer perforated wall have a circular profile. The circular profile may be in the direction perpendicular to the incoming flow of air through the air outlet.

In one embodiment of the invention, between the inner perforated wall and the outer perforated wall is mounted at least one annular support plate to maintain the distance from the inner perforated wall to the outer perforated wall and to limit a distortion of the pressure equalization chamber.

In one embodiment of the invention, the inner perforated wall and the outer perforated wall have a semicircular profile. The semicircular profile may be in the direction perpendicular to the incoming flow of air through the air outlet.

In one embodiment of the invention, the first perforated throttling plate or throttling mesh, or the second perforated throttling plate or throttling mesh, comprises at least one of a perforated metal plate, a perforated plastic plate, a metal mesh, a plastic mesh, a fiber mesh, a fabric mesh and a fiber mesh.

The embodiments of the invention described herein may be used in any combination with each other. Several or at least two of the embodiments may be combined together to form a further embodiment of the invention. An air distribution device to which the invention is related may comprise at least one of the embodiments of the invention described hereinbefore.

It is to be understood that any of the above embodiments or modifications can be applied singly or in combination to the respective aspects to which they refer, unless they are explicitly stated as excluding alternatives.

The benefits of the invention are related to improved air distribution with diminished noise induced by the air distribution device.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
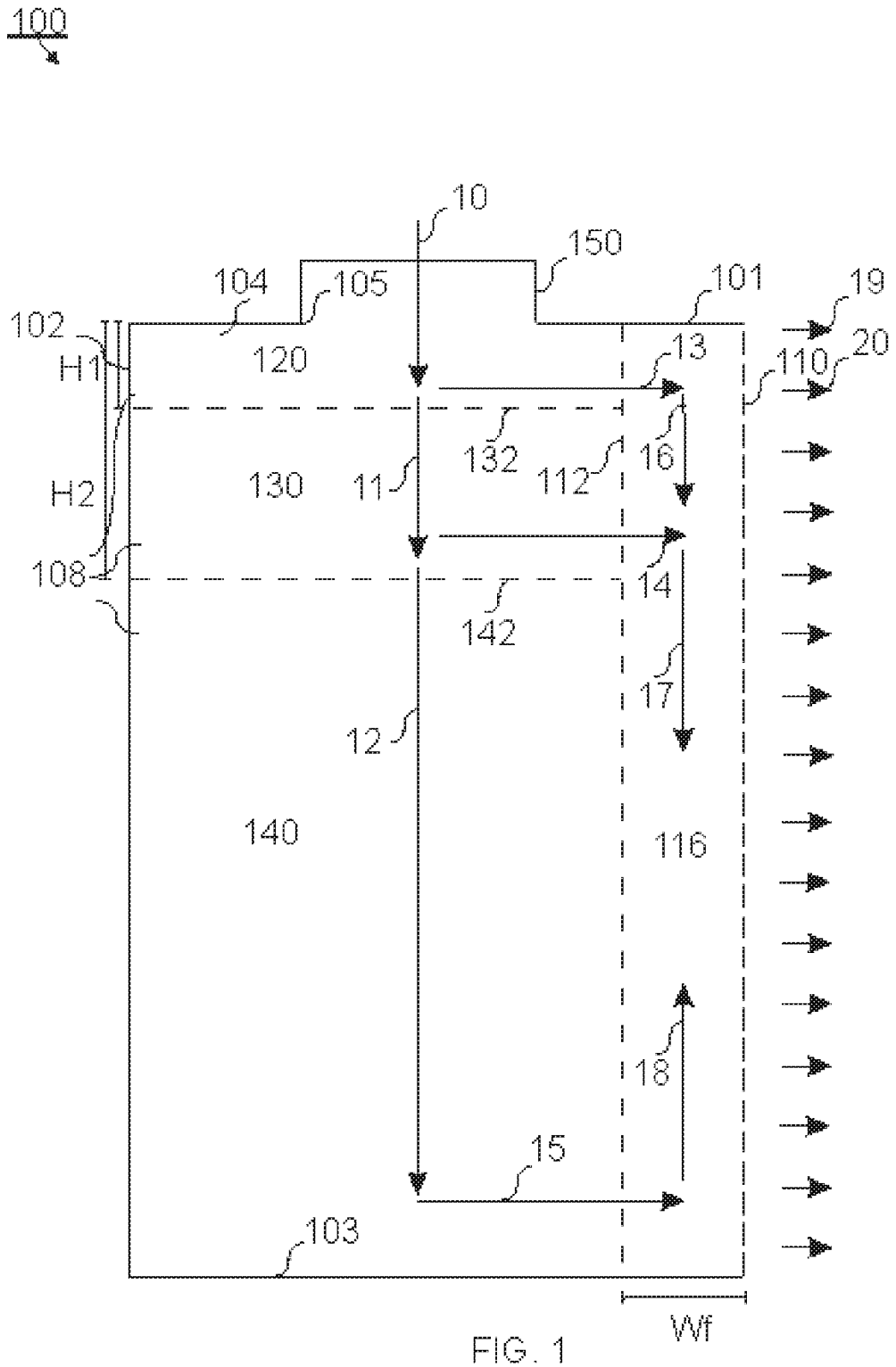
FIG. 1 illustrates an air distribution device in one embodiment of the invention.

FIG. 1 illustrates a cross section of an air distribution device 100 in one embodiment of the invention. Air distribution device 100 is connected to a supply air duct 150 that provides ventilation air as supply air to air distribution device 100. Air distribution device 100 comprises an air inlet plate 101 which has an air inlet opening 105 to which supply air duct 150 may be detachably mounted. The air inlet plate may be flat. On an opposite side of air distribution device 100 facing air inlet plate 101 there is an air impermeable plate 103 which may be flat. Air distribution device 100 has an interior space 108, which acts as an air distribution chamber for supply air. Interior space 108 may be bounded from sides by at least one air impermeable sidewall such as sidewall 104 and sidewall 102 illustrated in FIG. 1 and a perforated outer front plate 110 which acts as an air distribution surface for supply air into a room to be ventilated. In one embodiment of the invention, there is no air impermeable sidewall, but instead perforated outer front plate 110 has a circular profile. Front plate 110 may also be bent to have a semicircular, that is, a U-profile, which is why there may be only one air impermeable sidewall in one embodiment of the invention. A sidewall covering interior space 108 from view is not shown in FIG. 1 for illustrative purposes. Behind outer front plate 110 in the direction of incoming supply air is mounted a perforated inner front plate 112 which is parallel to the outer front plate 110 and has similar profile as outer front plate 110.

Between inner front plate 112 and outer front plate 110 there is arranged a pressure equalization chamber 116 which is separated from interior space 106 by inner front plate 112. The distance Wf between inner front plate 112 and outer front plate 110 is between 10 mm and 30 mm. In case the distance Wf exceeds significantly 30 mm air starts to flow between inner front plate 112 and outer front plate 110. Perforated inner front plate 112 and perforated outer front plate 110 may have uniformly spaced holes or other type of perforations such as rectangles Inner front plate 112 has a larger hole-free area, that is, perforation-free area than outer front plate 110. The hydraulic diameter of perforations in outer front plate may be less than 3 mm. If perforations in outer front plate 110 are circular their diameter may be less than 3 mm. The space between inner front plate 112 and outer front plate 110 may also be divided into at least two partitions or zones. The partitioning is achieved by at least one plate that is arranged between inner front plate 112 and outer front plate 110.

The space between inner front plate 112 and outer front plate 110 serves as a pressure compensation chamber for the air pressure gradient between interior space 106 and outside room air. Supply air duct 150 is illustrated in FIG. 1 to be perpendicular to inner space 108 and inner front plate 112.

Interior space 108 is further divided into at least two air chambers with at least one air permeable separating plate perpendicular to inner front plate 112 and the at least one sidewall such as sidewall 104. The at least one air permeable separating plate is substantially perpendicular to an incoming flow of ventilation air from supply air duct 150. The at least one air permeable separating plate may be substantially parallel to air inlet plate 101 and substantially parallel to air impermeable plate 103. The at least one air permeable separating plate acts as a throttling plate which slows down flow of air from supply air duct 150 across interior space 108, which causes a reduction of noise in air distribution device 100. The at least one air permeable separating plate is air permeable by virtue of perforations or holes. There is at least a first air permeable separating plate 132 which is mounted within a distance H1 of less than 50 mm from air inlet plate 101 or a point of contact between air inlet plate 101 and inner front plate 112. A first air chamber 120 is bounded by first air permeable separating plate or mesh 132 from the rest of interior space 108. First air chamber 120 is located in an interior space between air inlet plate 101 and first air permeable separating plate or mesh 132. In one embodiment of the invention, there is a second air permeable separating plate or mesh 142 which is mounted within a distance H2 of over 300 mm from air inlet plate 101 or a point of contact between air inlet plate 101 and inner front plate 112. Thus, in this embodiment there is a second air chamber 130 bounded by first air permeable separating plate or mesh 132 and second air permeable separating plate or mesh 142. The rest of interior space not included in first air chamber 120 or second air chamber 130 may also be referred as third air chamber 140.

The flow of air through opening 105 in air inlet plate 101 is illustrated with arrow 10. Air flow through first air permeable separating plate is illustrated with arrow 11, whereas air flow through second air permeable separating plate 142 is illustrated with arrow 12. Due to the throttling effect of first air permeable separating plate or mesh 132 part of air flowing through opening 105 in air inlet plate 101 is deflected to flow parallel to first air permeable separating plate or mesh 132, as illustrated with arrow 13. Similarly, second air permeable separating plate or mesh 142 causes part of air flowing through first air permeable separating plate or mesh 132 to be deflected as a flow parallel to second air permeable separating plate or mesh 142, as illustrated with arrow 14. Air flow deflected by air impermeable plate 103 is illustrated with arrow 15. Pressure-equalizing airflows in pressure equalization chamber 116 are illustrated with arrows 16, 17 and 18. Pressure equalization chamber 116 causes a uniform flow of air through whole outer front plate 110 as illustrated with vertical arrows in FIG. 1 such as arrows 19 and 20.

In one embodiment of the invention, an air permeable separating plate or mesh may be, for example, at least one of a perforated metal plate, a perforated plastic plate, a metal mesh, a plastic mesh, a fiber mesh, a fabric mesh and a fiber mesh. The air permeable separating plate or the mesh throttles air flow and may be referred to as a throttling plate or a throttling mesh.

In one embodiment of the invention, the small hydraulic diameter of the perforations in the outer perforated wall which may be less than 3 millimeters causes ventilation air through outer front plate 110 to form a plurality of small jets of air into which room air is induced. Thus, velocity of air from air distribution device 100 is reduced.

In one embodiment of the invention, the interior space 108 is provided supply air via two supply air ducts. There may, for example, be a second opening for supply air in at least one of air inlet plate 101, plate 103, sidewall 102, sidewall 104 and sidewall 106.

Figure 2:
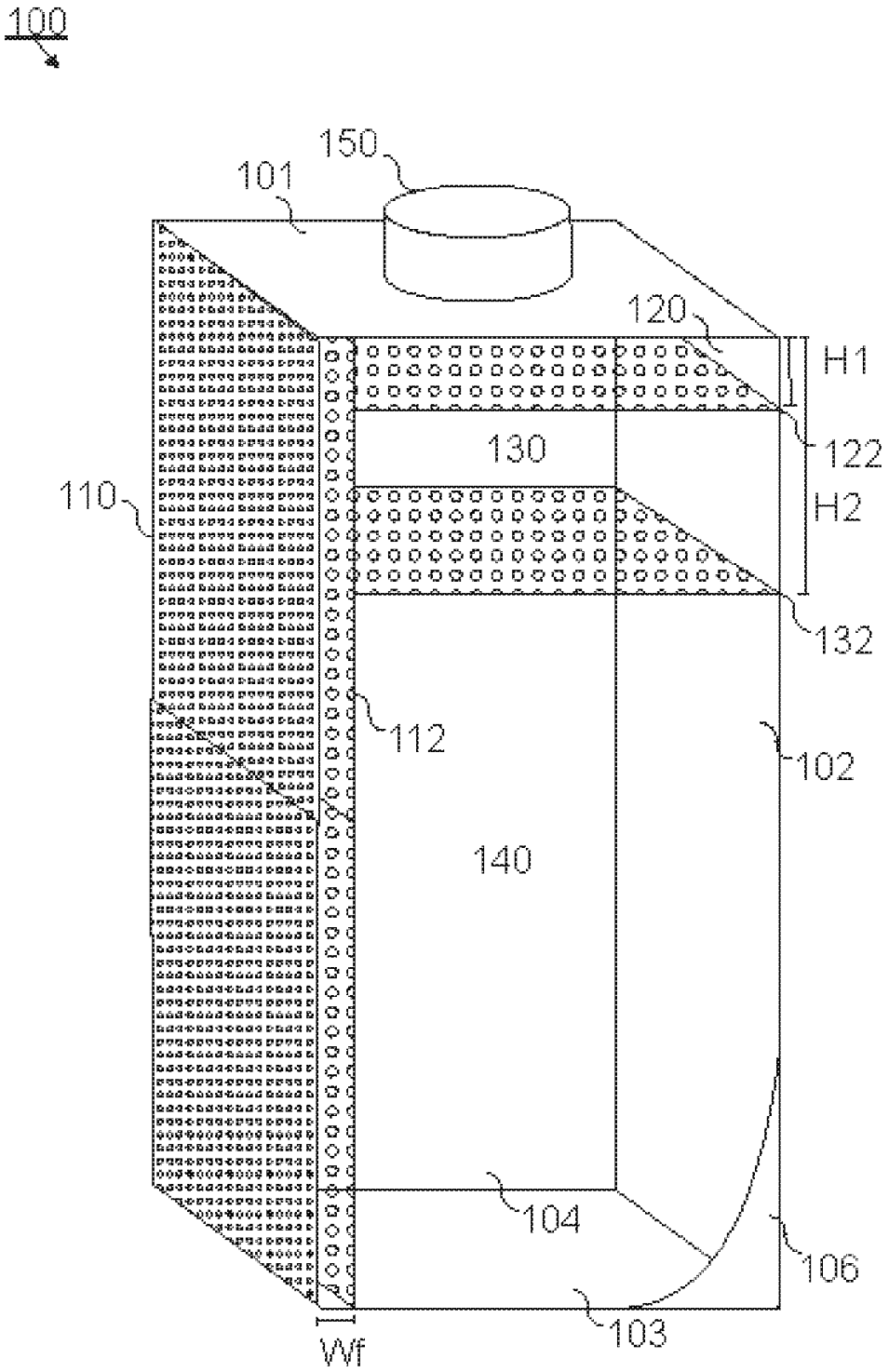
FIG. 2 illustrates an air distribution device having a rectangular profile in one embodiment of the invention.

FIG. 2 illustrates an air distribution device having a rectangular profile in one embodiment of the invention.

In FIG. 2 there is illustrated an air distribution device that is structurally similar to air distribution device 100 illustrated in FIG. 1. The rectangular profile of air distribution device 100 is seen in the direction perpendicular to the airflow from a supply air duct to an internal space of air distribution device similar to internal space 108 in FIG. 1. Rectangular profile comprises sidewalls 102, 104 and 106 as well as inner front plate 112. Sidewall 106 is shown only partially.

Figure 3:
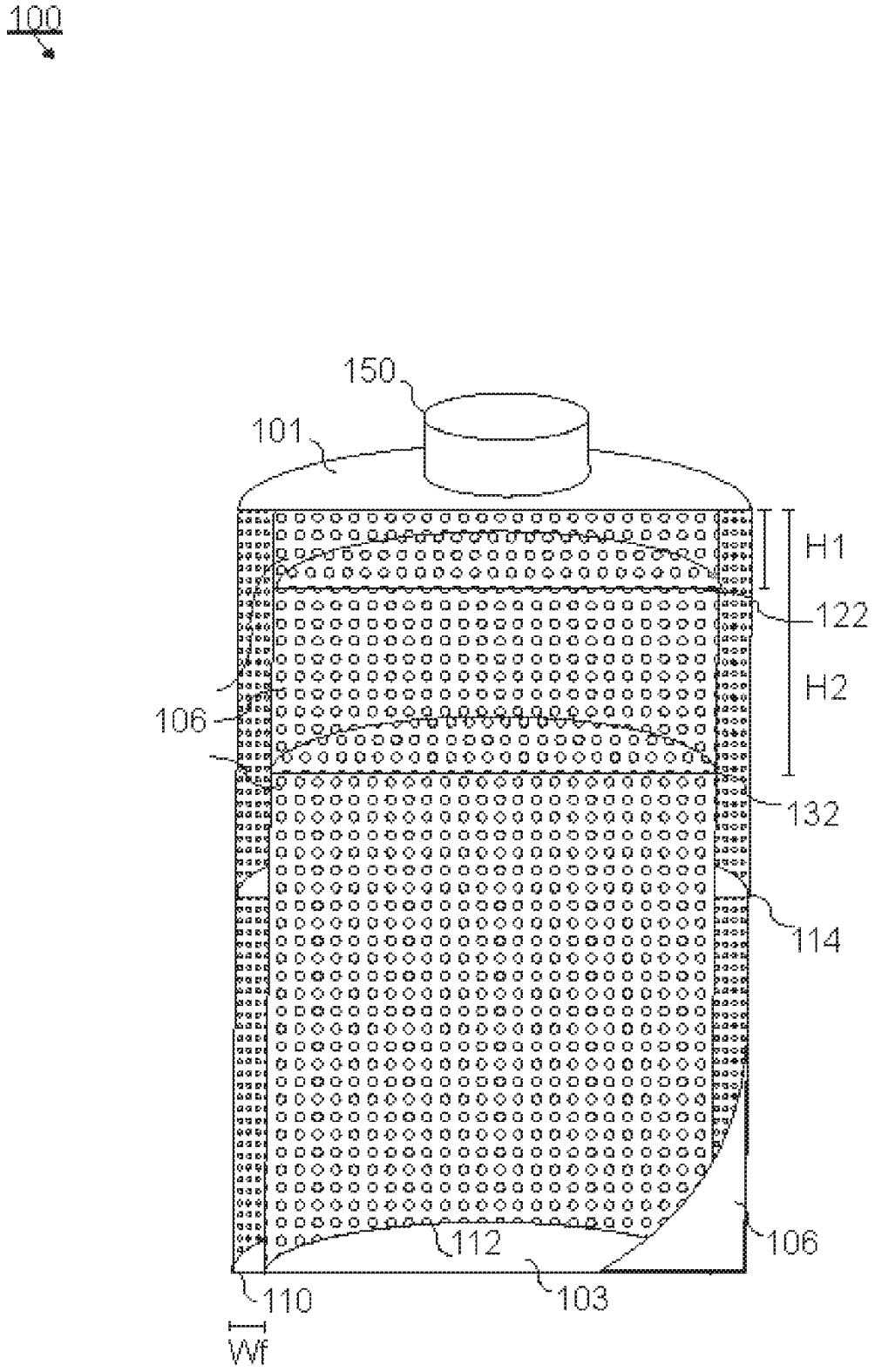
FIG. 3 illustrates an air distribution having a semicircular profile in one embodiment of the invention.

FIG. 3 illustrates an air distribution device having a semicircular profile in one embodiment of the invention.

The air distribution device illustrated in FIG. 3 is functionally similar to air distribution device illustrated in FIG. 1.

In FIG. 3 outer front plate 110 is bent to a semicircular shape so that internal space 108 is bounded by outer front plate 110 and air impermeable sidewall 106 in transverse direction with respect to supply air flow coming into air distribution device 100. Internal space 108 is also bounded an air inlet plate 101 which has opening 105 to which air supply duct 150 is mounted. Opposite to air inlet plate 101 is air impermeable plate 103. Also inner front plate 112 is bent to a semicircular shape. The distance between outer front plate 110 and inner front plate 112 is arranged to be Wf, that is, between 10-30 mm. Thus, a radius of a semicircle formed by inner front plate 112 is smaller than a radius of semicircle formed by outer front plate 110 by Wf. As in FIGS. 1 and 2, the space between inner front plate 112 and outer front plate 110 acts as a pressure equalization chamber. There may be at least one support plate mounted between outer front plate 110 and inner front plate 112 such as support plate 114, which keeps outer front plate 110 and inner front plate 112 at a uniform distance from each other and, thus, ensures that a shape of the pressure equalization chamber is not distorted. Support plate 114 has an outer edge which is fixed to outer front plate 110 and an inner edge which is fixed to inner front plate 112.

The embodiments of the invention described hereinbefore in association with the FIGS. 1, 2 and 3 and the summary of the invention may be used in any combination with each other. At least two of the embodiments may be combined together to form a further embodiment of the invention.

It is obvious to a person skilled in the art that with the advancement of technology, the basic idea of the invention may be implemented in various ways. The invention and its embodiments are thus not limited to the examples described above, instead they may vary within the scope of the claims.

What is claimed is:

1. An air distribution device, comprising:

an air inlet for ventilation air;

an air distribution chamber arranged to receive a flow of ventilation air from the air inlet, the air distribution chamber being bounded by at least:

an inner perforated wall allowing air to exit from the distribution chamber, an air impermeable wall opposite the air inlet and an air impermeable wall contiguous with the air inlet, wherein the inner perforated wall is connected to the air impermeable wall opposite the air inlet and to the air impermeable wall contiguous with the air inlet, and wherein the air distribution chamber is subdivided by a plurality of perforated throttling plates or throttling meshes with at least one perforated throttling plate or throttling mesh mounted perpendicular to the inner perforated wall and perpendicular to the flow of ventilation air from the air inlet into the air distribution chamber and each of the perforated throttling plate or throttling mesh extends throughout a cross-section area of the distribution chamber;

wherein a first perforated throttling plate or throttling mesh is mounted at a distance of less than 50 millimeters from the air inlet; and a pressure equalization chamber bounded by the inner perforated wall and an outer perforated wall parallel to and located within a distance from the inner perforated wall, a section of the air impermeable wall opposite the air inlet and a section of the air impermeable wall contiguous with the air inlet, wherein the perforations in the outer perforated wall have a hydraulic diameter that are smaller than the perforations in the inner perforated wall, wherein a perforation-free area of the outer perforated wall is smaller than the perforation-free area of the inner perforated wall in order to equalize ventilation air pressure in the pressure equalization chamber and to provide a uniform flow of air through the outer perforated wall.

2. The air distribution device according to claim 1, wherein the pressure equalization chamber forms a single elongate cavity extending the length of the inner perforated wall.

3. The air distribution device according to claim 2, wherein the air impermeable wall contiguous with the air inlet is flat.

4. The air distribution device according to claim 1, wherein the distance between the inner perforated wall and the outer perforated wall is between 10 millimeters and 30 millimeters.

5. The air distribution device according to claim 1, wherein the first perforated throttling plate or throttling mesh comprises at least one of a perforated metal plate, a perforated plastic plate, a metal mesh, a plastic mesh, a fabric mesh and a fiber mesh.

6. The air distribution device according to claim 1, wherein a second perforated throttling plate or throttling mesh is mounted at a distance of more than 300 millimeters from the air inlet.

7. The air distribution device according to claim 6, wherein the second perforated throttling plate or throttling mesh comprises at least one of a perforated metal plate, a perforated plastic plate, a metal mesh, a plastic mesh, a fabric mesh and a fiber mesh.

8. The air distribution device according to claim 1, wherein the hydraulic diameter of the perforations in the outer perforated wall is less than 3 millimeters.

9. The air distribution device according to claim 1, wherein the perforations in the inner perforated wall are circular.

10. The air distribution device according to claim 1, wherein the perforations in the outer perforated wall are circular.

11. The air distribution device according to claim 1, wherein the inner perforated wall and the outer perforated wall are flat.

12. The air distribution device according to claim 1, wherein the inner perforated wall and the outer perforated wall have a circular profile.

13. The air distribution device according to claim 1, wherein between the inner perforated wall and the outer perforated wall is mounted at least one annular support plate to maintain the distance from the inner perforated wall to the outer perforated wall and to limit a distortion of the pressure equalization chamber.

14. The air distribution device according to claim 1, wherein the inner perforated wall and the outer perforated wall have a semicircular profile.

15. An air distribution device, comprising:

an air inlet for ventilation air;

an air distribution chamber arranged to receive a flow of ventilation air from the air inlet, the air distribution chamber being bounded by at least:

an inner perforated wall allowing air to exit from the distribution chamber, an air impermeable wall opposite the air inlet and an air impermeable wall contiguous with the air inlet, wherein the inner perforated wall is connected to the air impermeable wall opposite the air inlet and to the air impermeable wall contiguous with the air inlet, and wherein the air distribution chamber is subdivided by at least a first and a second perforated throttling plates or throttling meshes mounted perpendicular to the inner perforated wall and perpendicular to an axis of the flow of ventilation air from the air inlet into the air distribution chamber and the perforated throttling plates or throttling meshes extending throughout a cross-section area of the distribution chamber;

wherein a first perforated throttling plate or throttling mesh is mounted at a distance of less than 50 millimeters from the air inlet;

wherein a second perforated throttling plate or throttling mesh is mounted at a distance of more than 300 millimeters from the air inlet; and a pressure equalization chamber located between the inner perforated wall and an outer perforated wall located parallel to and within a distance of 10 millimeters to 30 millimeters from the inner perforated wall, a section of the air impermeable wall opposite the air inlet and a section of the air impermeable wall contiguous with the air inlet, wherein the perforations in the outer perforated wall have a hydraulic diameter that are smaller than the perforations in the inner perforated wall, wherein a perforation-free area of the outer perforated wall is smaller than the perforation-free area of the inner perforated wall in order to equalize ventilation air pressure in the pressure equalization chamber and to provide a uniform flow of air through the outer perforated wall.

16. The air distribution device according to claim 15, wherein the inner perforated wall and the outer perforated wall are flat.

17. The air distribution device according to claim 15, wherein the inner perforated wall and the outer perforated wall are radially spaced apart coaxial circular cylindrical sections which are parallel to the axis of the air inlet.

18. The air distribution device according to claim 15, wherein the pressure equalization chamber forms a single elongate cavity extending the length of the inner perforated wall from the section.

19. The air distribution device according to claim 15, wherein the hydraulic diameter of the perforations in the outer perforations on the outer perforated wall are less than 3 mm.

* * * * *